United States Patent [19]

Norris, Sr.

[11] 4,334,145

[45] Jun. 8, 1982

[54] ENERGIZED RANGE BURNER SIGNAL

[76] Inventor: Robert L. Norris, Sr., 2701 E. Utopia #112, Phoenix, Ariz. 85024

[21] Appl. No.: 194,580

[22] Filed: Oct. 6, 1980

[51] Int. Cl.[3] ..... H05B 1/02; H05B 3/68

[52] U.S. Cl. ..... 219/453; 219/518

[58] Field of Search ..... 219/450–453, 219/518; 340/640, 641, 666, 667, 635; 200/85 R, 85 A

[56] References Cited

U.S. PATENT DOCUMENTS

| | | | |
|---|---|---|---|
| 2,681,973 | 6/1954 | Macoicz | 219/453 |
| 3,852,728 | 12/1974 | Flagg, Jr. | 219/453 |
| 4,214,150 | 7/1980 | Cunningham | 219/518 |

FOREIGN PATENT DOCUMENTS

| | | | |
|---|---|---|---|
| 611696 | 11/1948 | United Kingdom | 219/518 |

*Primary Examiner*—B. A. Reynolds
*Assistant Examiner*—Bernard Roskoski
*Attorney, Agent, or Firm*—Don J. Flickinger

[57] ABSTRACT

When a top burner of the electric range is energized, a sensible signal means is simultaneously activated. This sensible signal means is deactivated by the act of placing a cooking utensil upon said energized top burner. Circuit means are provided for electrically coupling energy from the energized top burner of the electric range. Such circuit means will include electric switching devices which are operative to deactivate the sensible signal when a cooking utensil is placed upon the energized top burner.

10 Claims, 6 Drawing Figures

ENERGIZED RANGE BURNER SIGNAL

BACKGROUND

1. Field of the Invention

The invention relates to the field of electric ranges. More particularly, the invention relates to the field of altering apparatus for providing a signal to create a sensate response in a person utilizing an electric range to alert said person that one or more burners of said electric range has been energized. Most specifically, the invention relates to the field of apparatus which provides a sensible signal when a burner of an electric range has been energized in the absence of a cooking utensil on said burner.

2. Prior Art

As is well known, most electric ranges marketed today provide some visible form of signal to indicate that electrical energy is being provided to energize a particular range burner. No electric ranges are known which provide a sensible signal to alert the user that energy is being provided to an untended range burner, that is, a burner on which no cooking utensil has been placed.

Many proponents of the prior art has provided devices which prevent an electric burner from being energized unless a cooking utensil has first been placed atop the electric burner. Examples of the prior art include the U.S. patents here now noted. U.S. Pat. Nos. 1,064,358 to Mettler on June 10, 1913; 1,637,155 to Marsden on July 26, 1927; 2,516,503 to Bock on July 25, 1950; 2,528,060 to Kershaw et al on Oct. 31, 1950; 2,534,097 to Akeley on Dec. 12, 1950; and 2,660,658 to Wagner et al on Nov. 24, 1953. Such devices are, in general, all special purpose devices whose function is provided for at the time of manufacture. Each requires that the placement of a cooking utensil shall cause a switch to be operated so as to provide the necessary electrical energy to the heating element of the burner. In general, this means that the switch must carry the full heating current of the burner element. This implies, in turn, that the switch contacts must be capable of handling the high current load required for proper operation of the burner.

Petrone in U.S. Pat. No. 2,013,172, issued Sept. 3, 1953, teaches an electric coffee maker which is energized through the operation of an electrically timed switch. In the production of coffee in the subject invention, a coffee cup is filled with freshly perculated coffee. The weight of the coffee-filled cup causes the power to be removed from the burner element of the coffee maker and provides for the closing of contacts so as to produce an audible alarm to alert the user that a cup of coffee has been prepared. As with the earlier cited references, the heating element cannot be energized until the coffee cup has been placed in position thus closing switch contacts which must be suitably sized to efficiently conduct the full current necessary to energize the heating element of the coffee maker. The heating element cannot be inadvertently energized without the coffee cup in position. Thus, there is no need when practicing the Petrone invention of providing for a sensible alarm to indicate an untended energized heating element.

Lambert in U.S. Pat. No. 2,674,675 issued Apr. 6, 1954, provides a signaling system which is operated by the weight of a drinking glass or other fluid container placed upon a switch which causes the switch to operate and energize the signaling system. This signaling system is designed for use in bars, restaurants and the like to facilitate the attracting of an attendant when one of several patrons desires to be served. Placing one's empty glass atop the switch actuating device energizes a visible signal to attract the waiter.

No present day countertop electric ranges are equipped to signal the absence of a cooking utensil on an energized burner. Often, in the course of preparing a meal, a utensil will be removed from the stove top without de-energizing the burner. Where burner controls are clustered, as in many of todays electric ranges, the person utilizing the range will frequently operate the wrong control whereby an unintended burner is energized while the intended burner remains cool and energy is wastefully expended and the completion of cooking preparations delayed.

It is an object of the present invention to provide apparatus for altering a person of an untended, energized top burner of an electric range.

It is a further objective of the invention to provide a sensible signal when the top burner of an electric range is energized and to de-activate said sensible signal when a cooking utensil is placed upon said energized top burner.

Another objective of the invention is the provision of means and method for retrofitting an existing electric range so as to provide apparatus for altering a person of an untended, energized, top burner of said electric range.

It is a specific objective of the invention to provide a signal which will create a sensate response in a person in the vicinity of an electric range to indicate the presence of an energized, untended, top burner on said range.

SUMMARY OF THE INVENTION

Apparatus is provided for altering a person of an untended, energized, top burner of an electric range. When a top burner of the electric range is energized, a sensible signal means is simultaneously activated. This sensible signal means is deactivated by the act of placing a cooking utensil upon said energized top burner. Circuit means are provided for electrically coupling energy from the energized top burner of the electric range. Such circuit means will include electric switching devices which are operative to deactivate the sensible signal when a cooking utensil is placed upon the energized top burner. In a preferred embodiment of the invention, the placement of a cooking utensil on the top burner of the electric range mechanically operates the switch through a lever and fulcrum arrangement so as to prevent the sensible alarm from providing an output signal. When the cooking utensil is removed from the range top, biasing means cause the lever to pivot about its fulcrum point so as to switch the switching means to a position whereby a sensate response is produced in a person in the vicinity of the sensible alarm. A preferred embodiment of the invention provides an audible alarm when the electric range burner is energized in the absence of a cooking utensil thereon.

DETAILED DESCRIPTION OF THE INVENTION

Figure 1:
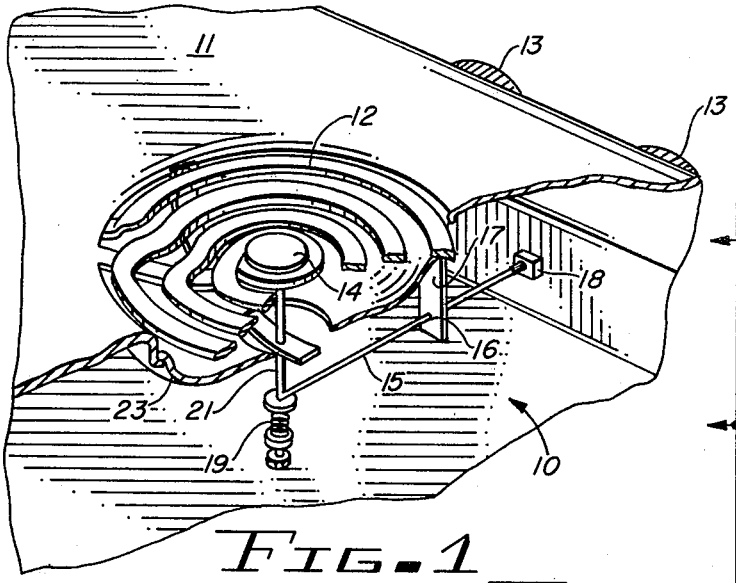
FIG. 1 is a perspective view of a top burner of an electric range sectionalized so as to clearly illustrate the lever and fulcrum arrangement for operating the switching means of the sensible alarm system.

FIG. 1 illustrates a portion of an electric cooking range 10 having a counter top 11 in which is set an electrical resistive heating element or calrod 12. A control, or selector, switch 13 couples heating element 12 to a source of electricity, typically commercially available ac power, in a manner well known to those skilled in the art.

At the center of calrod 12 reposes a movable platform 14 which is coupled by means of coupling rod 21 to lever 15. Lever 15 is supported at fulcrum point 16 of bracket 17.

Figure 2:
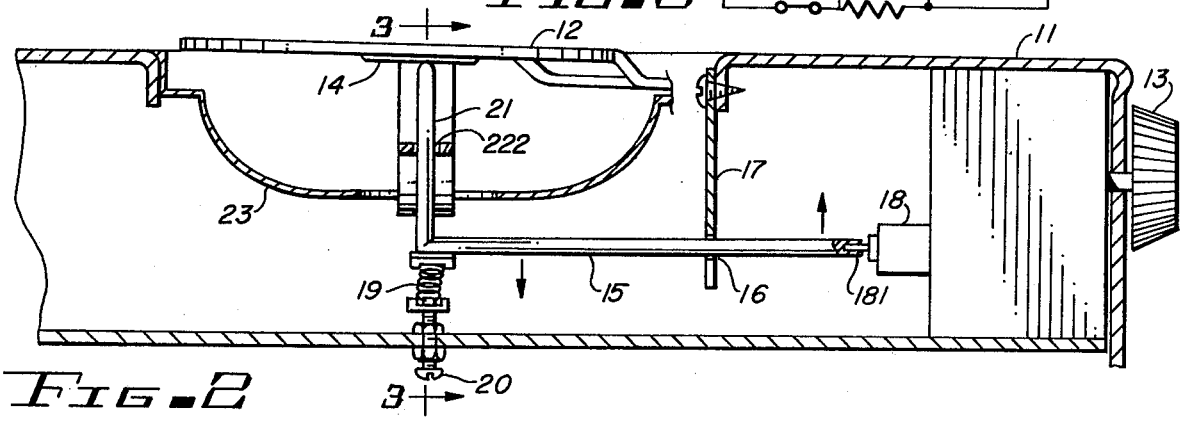
FIG. 2 is a side elevation of the invention showing the manner in which the range may be retrofitted to incorporate the lever and fulcrum device of the invention.

As is best seen in FIG. 2, lever 15 is coupled to the toggle 181 of alarm microswitch 18. When a cooking utensil, not shown, is placed atop calrod 12, movable platform 14 is depressed flush with the upper surface of calrod 12 as illustrated in FIG. 2. Spring 19 maintains an upward bias on lever 15, which bias is overcome by the depression of movable platform 14. When platform 14 is depressed downwardly, as when a cooking utensil is placed atop burner element 12, coupling rod 21 moves downwardly overcoming the upward biasing force applied to lever 15 by spring 19.

The downward motion coupled from moving platform 14 to lever 15 by coupling rod 21 is translated by fulcrum 16 as an upward movement of toggle 181 of microswitch 18. Thus, the status of alarm switch 18 is changed when a cooking utensil is placed atop calrod 12 or removed therefrom.

Threaded machine screw 20 may be adjusted to establish the force with which spring 19 biases lever 15 upwardly.

Each burner of electric range 10 may be equipped with a conventional drip pan 23.

Figure 3:
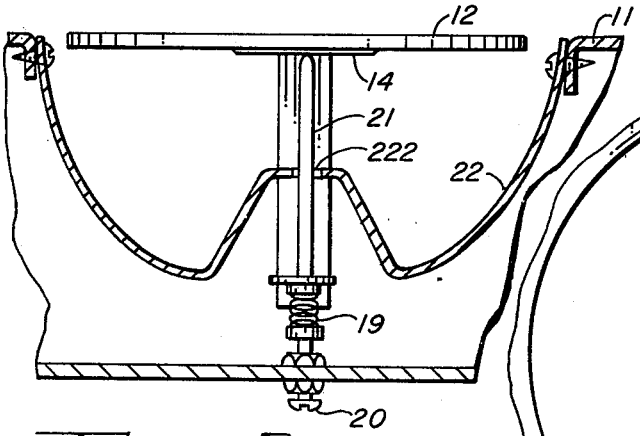
FIG. 3 is a side elevation along the line 3—3 of FIG. 2 illustrating the bracket supporting the coupling rod which communicates the presence of a cooking utensil on the burner to the lever arm of the invention.
Figure 4:
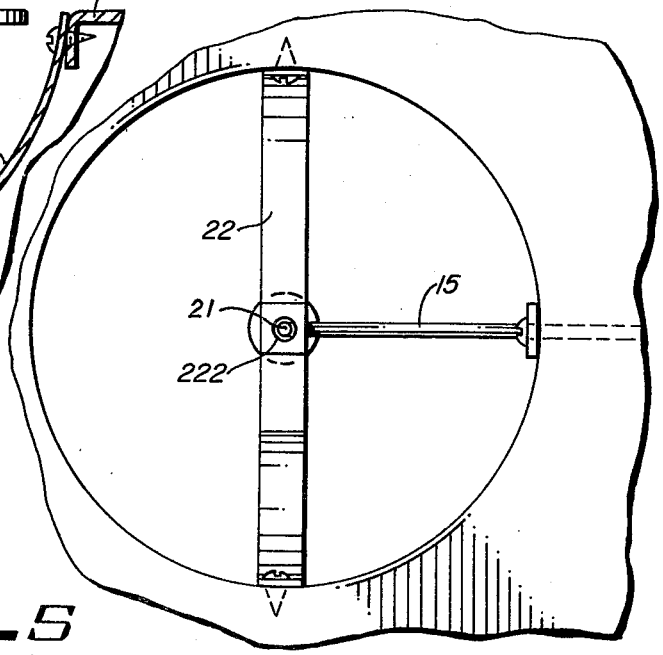
FIG. 4 is a plan view of the drawing of FIG. 2.

Coupling rod 21 is movably stabilized by passing it through opening 222 in stabilizing bracket 22. Bracket 22 is shown in detail in the side elevation of FIG. 3. FIG. 4 is a plan view illustrating support bracket 22 with coupling rod 21 passing through opening 222 therein.

As the illustrations of FIGS. 1–4 indicate, a conventional electric range may be readily retrofitted to provide the necessary moving platform 14, coupling rod 21, biasing means 19 and lever and fulcrum 15 and 16, respectively. This arrangement provides the means for mechanically operating the toggle 181 of microswitch 18. The purpose of microswitch 18 will be discussed in greater detail hereinafter when the schematic of FIG. 6 is discussed.

Figure 5:
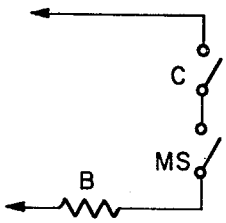
FIG. 5 (PRIOR ART)
FIG. 5 is a simple schematic of the prior art manner in which a switch was incorporated in series with the primary control switch and was usually operated by the presence of a cooking utensil so as to energize the heating element of the range.

As noted in the background discussion, much of the prior art concerns means whereby the placement of a cooking utensil on a heating element of an electric range resulted in the application of power to the heating element. FIG. 5 is a schematic diagram meant to represent a generalized concept of such prior art. Resistive element B represents the burner element of the device. Switch C is the main control switch which enables power to be applied to burner B. Switch MS in series with switch C, is operated by the placement of a cooking utensil atop burner B. When a cooking utensil is placed atop burner B, switch MS, in series with switch C, is closed and power is applied to burner B. When the cooking utensil is removed, switch MS is opened and power is removed from burner B. Burners which are energized when a weight is placed atop them are prone to being energized unexpectedly since their operation is so automatic that a person may activate the burner top switch MS inadvertently. Such inadvertent operation of a burner can be quite dangerous, causing fire or breakage in utensils unsuited for range top use or damage to cooking utensils which have no foods or liquids therein.

Figure 6:
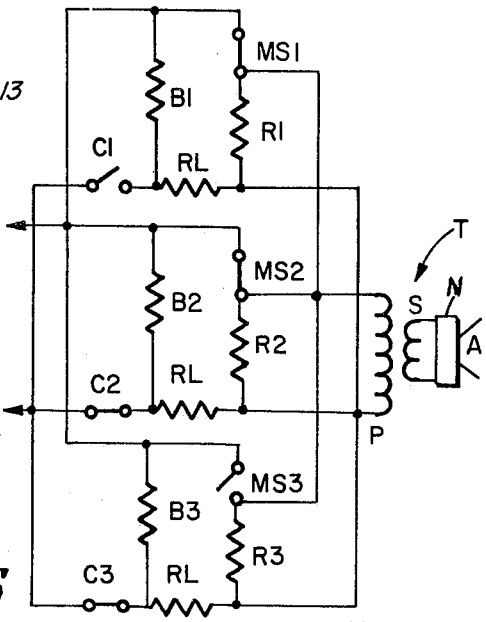
FIG. 6 is a schematic diagram of a presently preferred method whereby a sensible alarm is activated when the burner of an electric range is energized, said sensible alarm being deactivated when a cooking utensil is placed atop said burner.

FIG. 6 illustrates a presently preferred electrical configuration of the invention. Switches labeled with the letter C are analogous to electric range controls 13, whereas those switches labeled with the letters MS are analogous to switch 18, both control 13 and switch 18 being illustrated in FIGS. 1 and 2.

The schematic of FIG. 6 represents an electric range having three burner elements B1, B2 and B3. Closure of control switches C1–C3 cause burners B1–B3 to be energized. As illustrated in the drawing, control switch C1 is open and therefore burner B1 is nonenergized. Control switches C2 and C3 are closed and therefore burners B2 and B3 are energized. Each burner B has a voltage divider network, or alarm circuit comprised of resistors RL and R, as well as a microswitch MS, connected across it. Thus, across burner B1 is connected microswitch MS1, resistor R1 and limiting resistor RL. Across burner B2 is connected switch MS2, resistor R2 and another limiting resistor RL. Switch MS3, resistor R3 and a third limiting resistor RL are connected across burner B3.

When a switch MS is closed, the voltage presented across a given burner B will be developed across the voltage divider network, or alarm circuit, comprised of resistor R and limiting resistor RL. This will be true, however, only when switch MS is closed. This situation exists in FIG. 6 wherein switch MS1 is closed and the voltage across burner B1 is developed across the two resistors R1 and RL. Since control switch C1 is opened, the voltage across resistors R1 and RL is zero. However, since control switch C2 is closed, burner B2 is energized and, with switch MS2 closed, the voltage across burner B2 is developed across the divider network comprised of resistors R2 and limiting resistor RL.

In the case of burner B3, control switch C3 is closed and therefore burner B3 is energized. However, since switch MS3 is opened, no voltage is developed across voltage divider network R3-RL. As already noted, switches MS are analogous to switch 18 shown in FIGS. 1 and 2. For purposes of illustration and exposition, it will now be assumed that switches MS are in their normal closed position when no cooking utensil is atop calrod 12 so as to depress movable platform 14.

Placement of a cooking utensil on calrod 12 will depress unit 14 and cause switch MS (switch 18) to open.

In the schematic of FIG. 6, the primary P of transformer T of an alarm signal circuit is connected in shunt across resistors R1, R2, and R3. Thus, any voltage developed across these resistors will be impressed across primary P. Limiting resistors RL are selected to limit the current through each bleeder divider network to assure that the primary path of current flow will be through a given burner element B, and so that the voltage developed across resistors R1–R3 will be of a low order of magnitude so that transformer T may be of conveniently low power rating.

An alarm A, illustrated here for purposes of exposition only and not by way of limitation, as an audible alarm, is coupled to the secondary of transformer T. It is assumed that the coupling network N provides all the necessary electronics to cause alarm A to output a sensible signal when a voltage is impressed across primary P of transformer T.

With control C1 open, burner B1 is not energized and no voltage is developed across a resistor R1. Therefore, no sensible signal is provided as a result of the illustrated status of burner B1.

Burner B3 is illustrated as being energized by the closure of control C3. However, switch MS3 has been opened by the placement of a cooking utensil atop calrod unit 12 causing movable platform 14 to be depressed so as to move lever 15 about fulcrum point 16 so as to open switch 18 (MS3). Since switch MS3 is open, no voltage is developed across resistor R3 and therefore no sensible signal is generated at the output of alarm A by reason of the status of burner B3.

With respect to burner B2 of FIG. 6, closure of control C2 has energized burner B2. Switch MS2 is illustrated in its closed position indicating that burner B2 is untended and no cooking utensil is in place atop burner B2. Thus, a voltage will be developed across divider resister R2. This voltage will be impressed across primary winding P and coupled to alarm A to provide a sensible output signal which will alert the person using the range that burner B2 has been energized without a cooking utensil in place. Placement of a cooking utensil on burner B2 will cause switch MS2 to open and thereby deactivate alarm A.

Alarm A may be any sensible signal providing a sensate reaction in the person utilizing electric range 10. A presently preferred embodiment provides an audible alarm in the form of a repeated, intermittent note, such as might be output by a chiming device. The repeated intermittent note does not lend such an air of urgency to the alarm as might upset the person using the electric range, yet it maintains an air of insistence which cannot long be ignored. Thus, a person intending to only momentarily remove a cooking utensil from the heated burner element may do so without fear of being audibly blasted away from the vicinity of the electric range by reason of operation of the alarm circuit.

What has been described is apparatus for altering a person of an untended, energized burner element of an electric range. When an electric range burner has been energized an alarm circuit is simultaneously activated as well. Placement of a cooking utensil on the energized burner unit will act immediately to deactivate the alarm circuit. Should a cooking utensil be placed on a first burner element while a second burner element is inadvertently energized, the alarm circuitry will immediately alert the person utilizing the electric range of the problem. Thus, energy will be conserved and no cooking time will be wasted.

Those skilled in the art will conceive of other embodiments for providing a sensible alarm indicative of an energized, untended burner element of an electric range. It is believed that most such alternate embodiments will fall within the ambit of protection provided by the claims appended hereto.

Having described my invention in such clear and concise manner in the foregoing specification and the accompanying drawings that those skilled in the art may readily and simply practice the invention, that which I claim is:

1. In combination:

an electrical resistive heating element;

a selector switch for connecting a source of electrical power across said element;

a voltage divider network having two resistors and an alarm switch connected in series, said network being connected in parallel with the heating element;

means for opening the alarm switch when a utensil is placed on the heating element and for closing the switch when no utensil is present on the heating element; and alarm signal means for producing an alarm signal connected across one of the resistors of the network, said alarm signal circuit means producing an alarm signal only when a source of electrical power is connected across the heating element and no utensil is placed on the heating element.

2. The combination of claim 1 in which the source of electrical power produces an alternating electric current.

3. The combination of claim 2 in which the alarm signal means includes a transformer having a primary winding and a secondary winding, said primary winding being connected across a resistor of the network and means for producing an alarm signal being connected across the secondary winding of the transformer.

4. The combination of claim 3 in which the alarm signal is audible.

5. In an electrical range having a plurality of electrical resistive heating elements and selector switch means for connecting a source of electric power across each element, and an alarm apparatus comprising:

one of said plurality of alarm circuits, each alarm circuit including an alarm switch, one alarm circuit being associated with each heating element, and each alarm circuit being connected in parallel with its associated heating elements;

means for opening the alarm switch of an alarm circuit when a cooking utensil is placed on the heating element with which each alarm circuit is associated; and an alarm signal circuit means operatively connected to each alarm circuit for producing an audible alarm signal, said alarm signal circuit means producing audible alarm signals when a source of electrical power is connected across one of said heating elements and no cooking utensil is positioned on that heating element.

6. The alarm apparatus of claim 5 in which the source of electrical power produces an alternating electrical current.

7. The alarm apparatus of claim 6 in which each of the alarm circuits is a voltage divider network having at least two resistors.

8. The alarm apparatus of claim 7 in which the means for opening an alarm switch are mechanical means including a lever.

9. The alarm apparatus of claim 8 in which the alarm signal circuit means includes a transformer having a primary winding and a secondary winding, said primary winding being connected across a resistor of each of the voltage divider networks, and an alarm device for producing an audible alarm signal being connected across the secondary winding.

10. In combination:

an electrical resistive heating element;

a selector switch for connecting a source of electrical power across said element; and alarm circuit means for sensing when electrical power is connected across said element for sensing when a utensil is positioned on said element, and for producing an alarm signal only when power is connected across said element and no utensil is positioned on said element.

* * * * *